United States Patent [19]

DePaul

[11] Patent Number: 4,826,074

[45] Date of Patent: May 2, 1989

[54] CARTON AND BLANK FOR PACKAGING ICE CREAM OR THE LIKE

[75] Inventor: Richard E. DePaul, West Chester, Pa.

[73] Assignee: Sommerville Packaging Corporation, Newport News, Va.

[21] Appl. No.: 177,319

[22] Filed: Apr. 4, 1988

Related U.S. Application Data

[62] Division of Ser. No. 21,649, Mar. 4, 1987, Pat. No. 4,756,470.

[51] Int. Cl.[4] ..... B65D 5/22

[52] U.S. Cl. ..... 229/132; 206/611; 229/150; 229/152; 229/169; 229/178; 229/905

[58] Field of Search ..... 206/611, 624, 626, 631, 206/631.1; 229/132, 135, 141, 145, 149–152, 169, 178, 180, 905

[56] References Cited

U.S. PATENT DOCUMENTS

| | | | |
|---|---|---|---|
| 887,352 | 5/1908 | Sommer | 229/152 |
| 2,415,869 | 2/1947 | Coleman | 229/135 |
| 2,670,128 | 2/1954 | Stowitts | 229/132 |
| 3,109,577 | 11/1963 | Knipp | 206/626 |
| 3,144,980 | 8/1964 | Larson | 206/611 |
| 3,206,103 | 9/1965 | Bixler | 206/624 |
| 3,361,328 | 1/1968 | Buttery | 206/624 |
| 4,341,340 | 7/1982 | Lisiecki | 229/132 |
| 4,582,246 | 4/1986 | Lisiecki | 229/141 |
| 4,712,730 | 12/1987 | Froom | 206/626 |

*Primary Examiner*—Stephen Marcus
*Assistant Examiner*—Gary E. Elkins
*Attorney, Agent, or Firm*—Shlesinger & Myers

[57] ABSTRACT

The present invention discloses a blank and carton for packaging ice cream or the like comprising hingedly connected cover, rear, bottom and front panels. Left and right end flaps extending from each of the cover, rear, bottom and front panel end flaps. A pocket means formed in each of the carton ends for receiving a portion of the cover panel end flaps adjacent the rear panel for reforming the carton subsequent to the initial opening thereof. The pocket means includes rear panel end flaps forming exterior liners and the corresponding front and bottom panel end flaps forming interior liners. Membrane flaps are hingedly connected to the front panel and left and right front panel end flaps for forming a substantially continuous lip along a portion of the outer periphery of the carton.

18 Claims, 11 Drawing Sheets

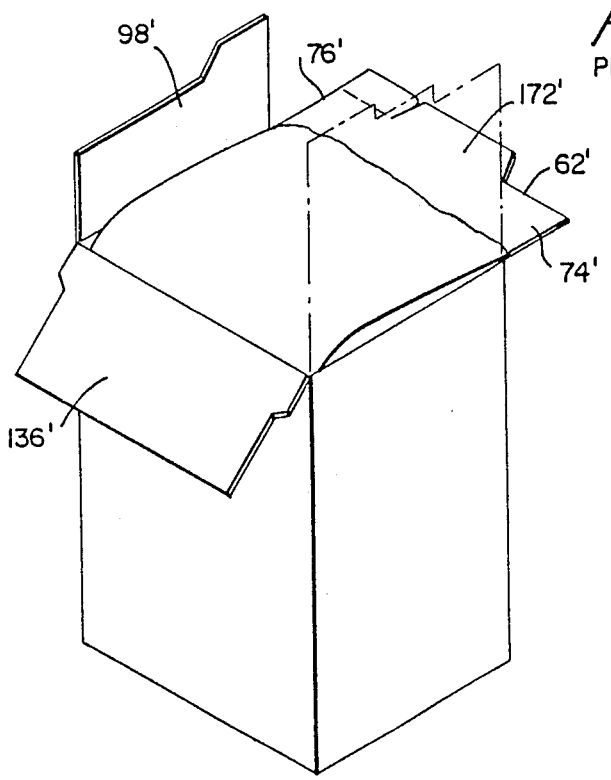
FIG 4
PRIOR ART
FIG 5
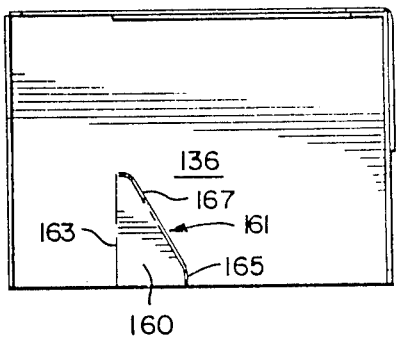
FIG 6
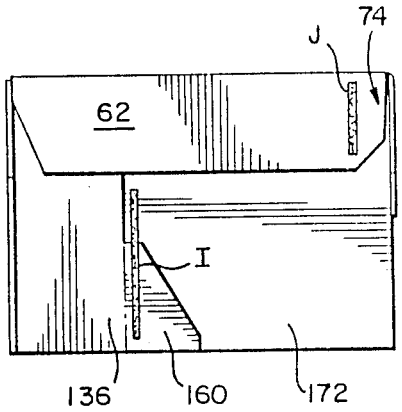
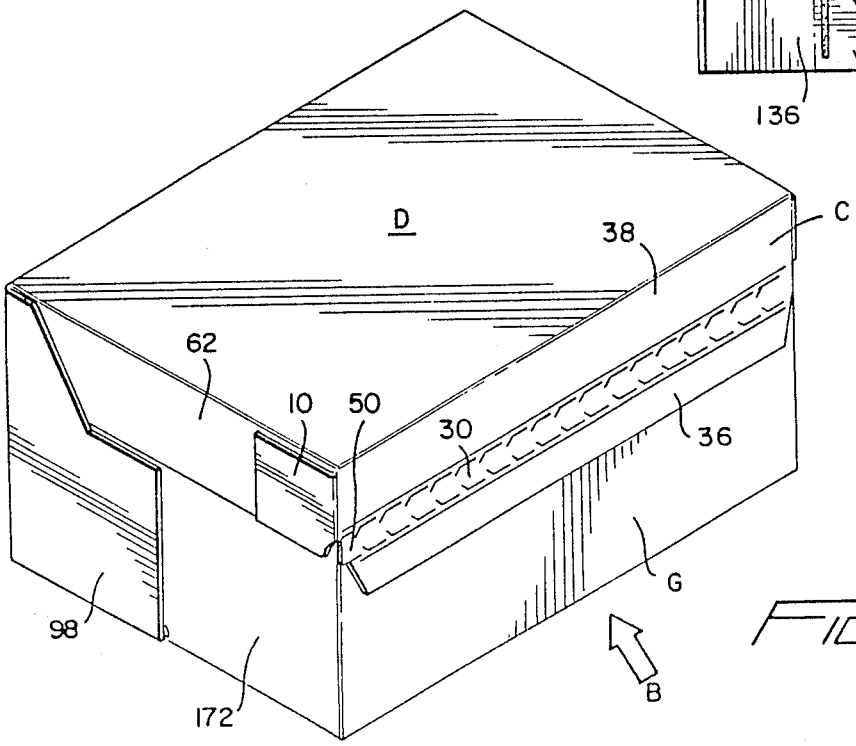
FIG 7

FIG 12
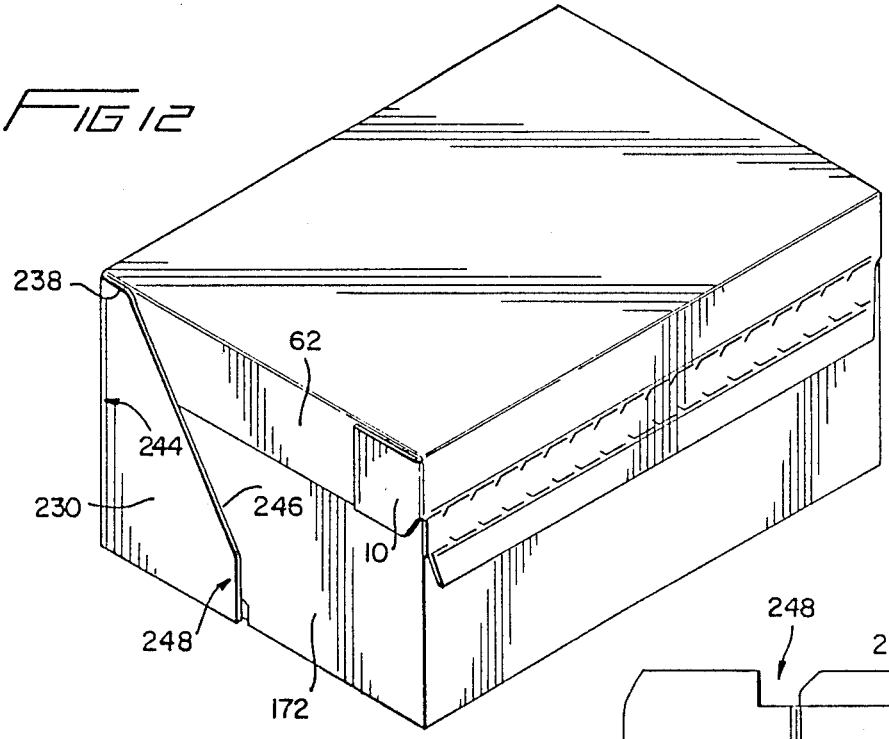
FIG 13
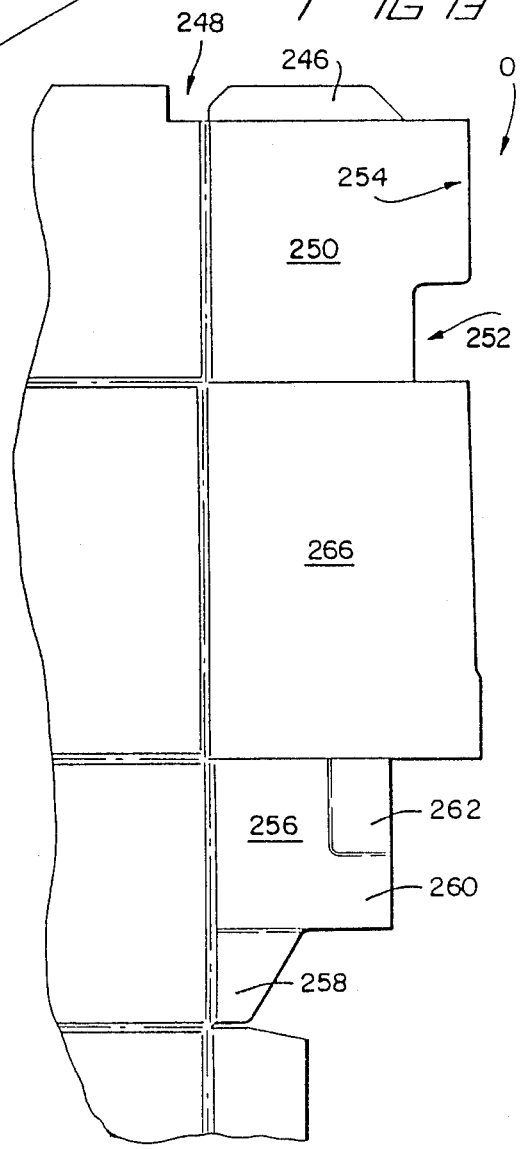
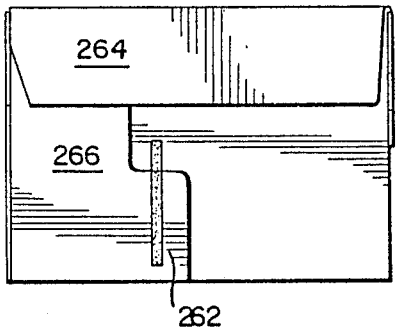
FIG 14
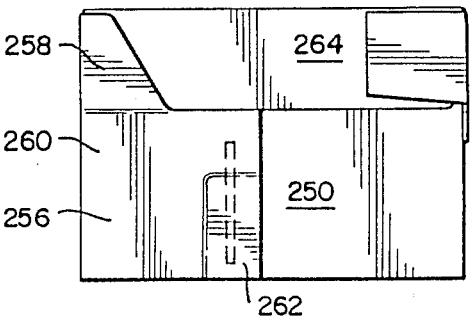
FIG 15

CARTON AND BLANK FOR PACKAGING ICE CREAM OR THE LIKE

This is a division of application Ser. No. 021,649, filed Mar. 4, 1987, Now U.S. Pat. No. 4,756,470 issued 7/12/88.

FIELD OF THE INVENTION

This invention pertains to a blank and a carton for packaging semi-liquids such as ice cream or the like. Specifically, a design for a carton blank that permits a consumer to readily reseal the carton subsequent to the initial opening thereof.

BACKGROUND OF THE INVENTION

A variety of designs for carton blanks have been proposed for enabling the consumer to reseal the carton subsequent to the initial opening thereof so that the carton can be readily stored. Further, numerous carton blanks have been suggested for improving the overall seal of the blank when fully erected, the adaptability of the carton blank to mechanical erecting devices, and the minimization of scrap stock material from which the blanks are formed. The following U.S. Pat. Nos. are indicative of the previously known designs for carton blanks: 1,509,383 Walter; 2,342,198 Hultin; 2,367,008 Davidson; 2,367,780 Inman; 2,369,385 Carruth; 2,496,043 Farrell; 3,040,957 Meyers; 3,097,783 Burt et al; 3,109,577 Knipp; 3,144,980 Larson; 3,168,233 Ignell; 3,194,479 Rumberger; 3,195,800 Cote; 3,197,114 Holmes; 3,206,103 Bixler; 3,206,915 Anderson; 3,265,285 Fanter; 3,281,055 Buttery; 3,309,834 Buttery; 3,543,997 Michetti; 3,833,165 Hoiles; 4,046,313 Perry; 4,084,489 Matovich; 4,239,115 Froom; 4,256,526 McDaniel; 4,555,027 Froom.

Prior to the present invention, the packaging industry has been unable to develop a carton for packaging semi-liquids such as ice cream or the like that is readily resealed subsequent to the initial opening thereof and includes carton ends providing sustantially continuous surfaces for facilitating printing thereon.

OBJECTS AND SUMMARY OF THE INVENTION

Accordingly, it is an object of the present invention to provide an improved blank and carton for packaging semi-liquids such as ice cream or the like.

Another object of the invention is to provide a carton blank that can be readily erected by mechanical means without residue from the contents contained therein forming on the outer surface of the carton blank.

Another object of the invention is to provide a carton that can be manufactured in multiples, from web or sheet stock, with minimum waste or scrap produced during the blanking operation and efficient nesting of one blank against another.

Yet another object of the invention is to provide a carton, for packaging semi-liquids such as ice cream or the like with a superior seal.

A further object of the invention is to provide a carton that can be readily resealed after the initial opening of the same.

A further object of the invention is to provide a carton including ends having a substantially continuous surface for facilitating printing thereon.

Yet another object of the invention is to provide a carton blank with staggered vertically extending hinge lines formed intermediate the carton body panels and the corresponding end flaps for reducing the stress thereon upon sealing of the carton ends.

In summary, the present invention discloses a novel design for a carton blank including membranes extending from the front panel end flaps and the front panel for forming a substantially continuous lip about a portion of the outer periphery of the carton.

DESCRIPTION OF THE DRAWINGS

FIG. 4 is a perspective view of a prior art ice cream carton filled with ice cream and having the top end open.

FIG. 5. is a side elevation view of the left end of the carton with only the bottom panel end flap folded inwardly.

FIG. 6 is a side elevation view of the left end of the carton depicting the end flaps folded inwardly with the exception of the rear panel end flap.

FIG. 7 is a perspective view of the sealed carton.

FIG. 12 is a perspective view of the sealed carton formed in accordance with the second embodiment of the present invention.

FIG. 13 is a fragmentary plan view of the inner surface of a third embodiment of a flat carton blank formed in accordance with the present invention.

FIG. 14 is a side elevation view of the left end of the third embodiment of the carton depicting the end flaps folded inwardly with the exception of the rear panel end flap.

FIG. 15 is a side elevation view of the third embodiment of the carton depicting the left carton end sealed.

DETAILED DESCRIPTION OF THE INVENTION

FIG. 1

Figure 1:
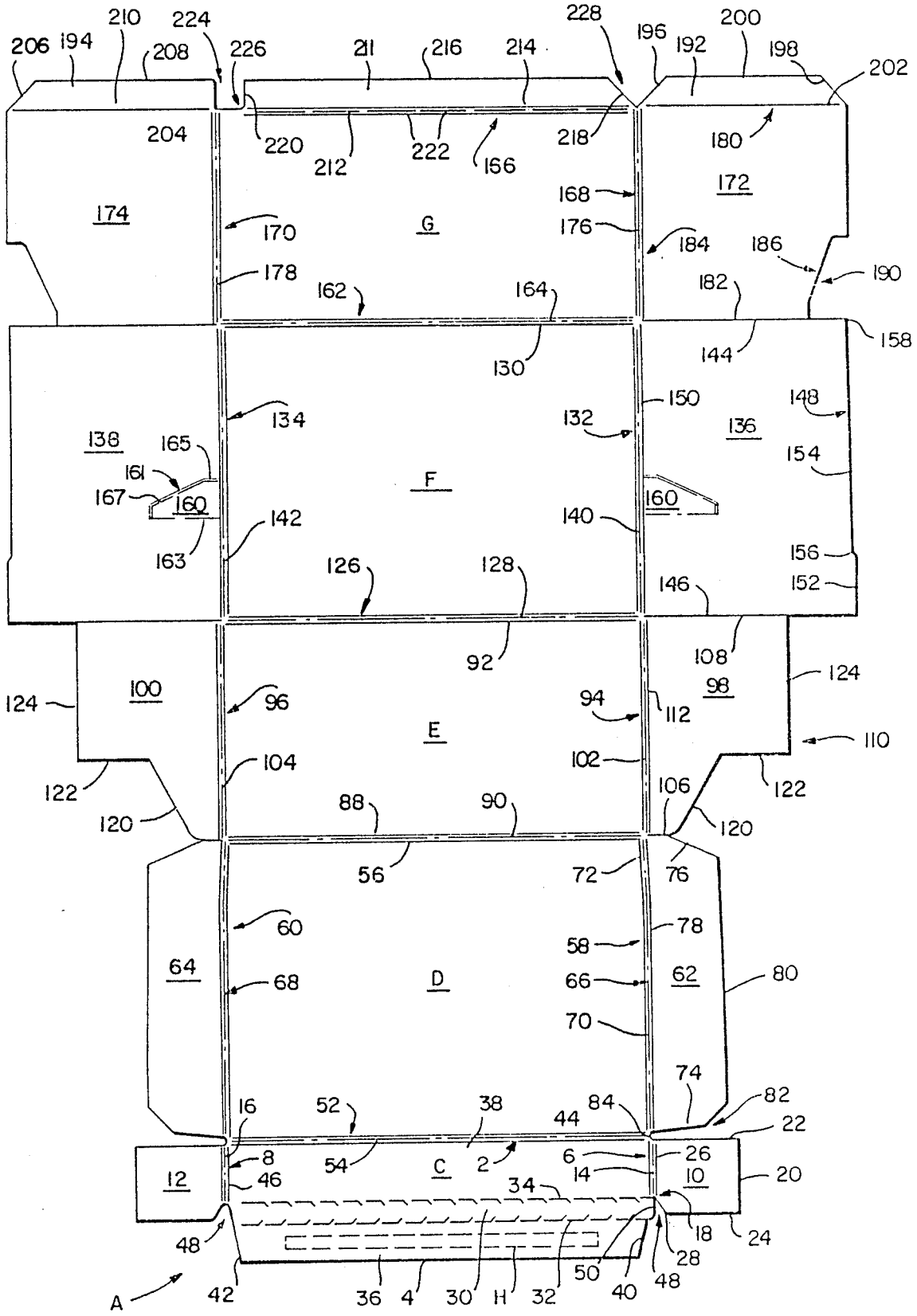
FIG. 1 is a plan view of the inner surface of a flat carton blank formed in accordance with the present invention.

The specific nomenclature assigned to each component and subcomponent comprising carton blank A refers to its orientation when carton blank A is fully erected and as viewed in the direction of arrow B in FIG. 7. Referring to FIG. 1, carton blank A is comprised of a closure flap C, a cover panel D, a rear panel E, a bottom panel F, and a front panel G. Closure flap C includes a top edge 2, a bottom edge 4, a left edge 6 and a right edge 8. Left and right cover or glue tabs 10 and 12 are hingedly connected to left and right edges 6 and 8 respectively forming vertically extending hinge lines 14 and 16 therebetween. Cover tabs 10 and 12 include front edge 18, rear edge 20, top edge 22 and bottom edge 24. Front edge 18 includes first and second portions 26 and 28. First portion 26 extends parallel to the corresponding hinge lines 14 and 16. Second portion 28 extends outwardly from first portion 26 and forms an obtuse angle less than 180° therewith. A tear strip 30 is formed in closure flap C and includes spaced weakness lines 32 and 34. Weakness lines 32 and 34 subdivide closure flap C into a glue panel or segment 36 and a skirt or resealable flap 38. Glue segment 36 includes a left end 40 and right end 42. Skirt 38 includes left and right ends 44 and 46 respectively. Left and right ends 44 and 46 extend substantially parallel to the corresponding hinge lines 14 and 16. Left and right ends 40 and 42 extend inwardly from left and right ends 44 and 46 respectively and form an obtuse angle therewith less than 180°. Thus, a notch or recess 48 is formed intermediate left and right ends 40 and 42 and the associated second portion 28 of glue tabs 10 and 12. Left edge 40 of glue segment 36 is formed inwardly from left end 44 of skirt 38 thereby forming tear tab 50. This arrangement of tear strip 30 enables a consumer to readily detach the cover panel D from the front panel G to gain access to the contents of the carton. It will be appreciated by one of ordinary skill in the art that various other types of tear tabs and tear strips may be used.

Cover panel D is hingedly connected at its front edge 52 to top edge 2 of closure flap C forming horizontally extending hinge line 54. Cover panel D further includes rear edge 56, left edge 58, and right edge 60. End flaps 62 and 64 are hingedly connected to left and right edges 58 and 60 respectively forming vertically extending hinge lines 66 and 68 therebetween. Vertically extending hinge lines 66 and 68 include first and second segments 70 and 72. First segment 70 is substantially perpendicular to hinge line 54 formed intermediate closure flap C and cover panel D. Second segment 72 extends inwardly from first segment 70 forming an obtuse angle therewith of less than 180°.

Cover panel end flaps 62 and 64 include front, rear, top, and bottom edges 74, 76, 78 and 80 respectively. Front edges 74 are spaced from the associated top edges 22 of glue or cover tabs 10 and 12 forming a notch 82 therebetween. Notches or recesses 82 include an arcuate radius 84 formed adjacent horizontally extending hinge line 54. Front edges 74 of cover panel end flaps 62 and 64 form acute angles with hinge lines 66 and 68 respectively.

Rear panel E is hingedly connected at its top edge 88 to rear edge 56 of cover panel D forming horizontally extending hinge line 90 therebetween. Rear panel E further includes bottom edge 92, left edge 94, and right edge 96. Rear panel end flaps 98 and 100 are hingedly connected to left and right edges 94 and 96 of rear panel E respectively. Vertically extending hinge lines 102 and 104 are formed therebetween.

Rear panel end flaps 98 and 100 are defined by top edges 106, bottom edges 108, front edges 110, and rear edges 112. Front edges 110 of rear panel end flaps 98 and 100 include first, second and third portions 120, 122, and 124 respectively. First portion 120 forms an obtuse angle less than 180° with top edge 106. Second portion 122 forms an obtuse angle with first portion 120 greater than 180° and extends substantially parallel to bottom edge 108. Third portion 124 forms a substantially right angle with second portion 122 and extends parallel to rear edge 112. Vertically extending hinge lines 102 and 104 are substantially aligned with first segments 70 of hinge lines 66 and 68 respectively and are offset from second segments 72. The second segments 72 are tapered inwardly to enhance the seal of the left and right rear corners of the carton.

Bottom panel F at its rear edge 126 is hingedly connected to bottom edge 92 of rear panel E forming horizontally extending hinge line 128 therebetween. Bottom panel F further includes front edge 130, left edge 132 and right edge 134. End flaps 136 and 138 are hingedly connected to left and right edges 132 and 134 respectively. Vertically extending hinge lines 140 and 142 are formed therebetween. Vertically extending hinge lines 140 and 142 are inwardly offset from hinge lines 102 and 104 respectively.

Rear panel end flaps 136 and 138 are defined by front, rear, top and bottom edges 144, 146, 148 and 150 respectively. Top edge 148 includes first and second portions 152 and 154. First portion 152 extends substantially parallel to bottom edge 150. Second portion 154 is inwardly offset from first portion 152 and is tapered such that end 156 of first portion 152 extends a distance from bottom edge 150 greater than end 158 extends therefrom. This configuration of top edge 148 of bottom panel end flaps 136 and 138 permit second portions 154 to act as cam surfaces. This feature will be more fully discussed below with reference to the assembly of the carton blank. Raised or offset sections 160 are formed in bottom panel end flaps 136 and 138 adjacent bottom edges 150. Offset portions 160 are substantially triangular in shape.

Front panel G is hingedly connected at its bottom edge 162 to front edge 130 of bottom panel F forming horizontally extending hinge line 164 therebetween. Front panel G further includes top edge 166, left edge 168, and right edge 170. End flaps 172 and 174 are hingedly connected to left and right edges 168 and 170 of front panel G respectively forming vertically extending hinge lines 176 and 178 therebetween. Hinge lines 176 and 178 are substantially aligned with hinge lines 102 and 104 respectively and offset from hinge lines 132 and 134 respectively.

Front panel end flaps 172 and 174 are defined by top edge 180, bottom edge 182, front edge 184, and rear edge 186. Rear edge 186 has cut-out 190 formed therein adjacent bottom edges 182. Cut-out 190 has a configuration substantially similar to raised or offset portions 160 of bottom panel end flaps 136 and 138.

Front panel end flap membranes 192 and 194 are hingedly connected to top edges 180 of front panel end flaps 172 and 174 respectively. End flap membrane 192 is defined by front edge 196, rear edge 198, inner edge 200 and outer edge 202. Front edge 196 extends outwardly from hinge line 176 and forms an obtuse angle therewith of about 135°. Rear edge 198 forms an obtuse angle with inner edge 200 less than 180°. End flap membrane 194 includes front edge 204, rear edge 206, inner edge 208, and outer edge 210. Front edge 204 is substantially aligned with vertically extending hinge line 178. Rear edge 206, similar to rear edge 198 of end flap membrane 192, forms an obtuse angle with inner edge 208.

Front panel membrane 211 is hingedly connected to top edge 166 of front panel G forming therebetween a horizontally extending hinge line 212. Front panel membrane 211 is defined by front edge 214, rear edge 216, left edge 218, and right edge 220. Hinge line 212 includes a plurality of slits 222 that extend completely through the thickness of the carton blank A. The function of slits 222 will be more fully discussed below. Right edge 220 is offset inwardly from hinge line 178 a distance equal to the length of front edge 204 of end flap membrane 194. Thus, a substantially rectangular shaped notch 224 is formed between front panel membrane 211 and end flap membrane 194. A radius 226 is formed in the corner of notch or recess 224 adjacent right edge 220 of front panel membrane 211. Left edge 218 extends inwardly from hinge line 176 and forms an angle of 135° therewith. A substantially V-shaped notch or recess 228 is formed between front panel membrane 211 and end flap membrane 192. Although the edges 196 and 218 are cut along a 45° angle, it would be obvious to one of ordinary skill in the art that edges 196 and 218 could be cut along any pair of complimentary angles, such as 60° and 30°.

An adhesive H in the form of a strip or other well known form is applied to glue segment 36 of closure flap C. Referring to FIG. 6, a single adhesive strip I is applied to bottom panel end flap 136 along raised or offset portion 160 and an adjacent portion of front panel end flap 172. In a similar manner, an adhesive strip is applied to bottom panel end flap 138 along raised or offset portion 160 and an adjacent portion of front panel end flap 174 (not shown). An adhesive strip J is applied to cover panel end flap 62 adjacent its front edge 74. Similarily, an adhesive strip J is applied to cover panel end flap 64 adjacent front edge 74 (not shown).

Figure 2:
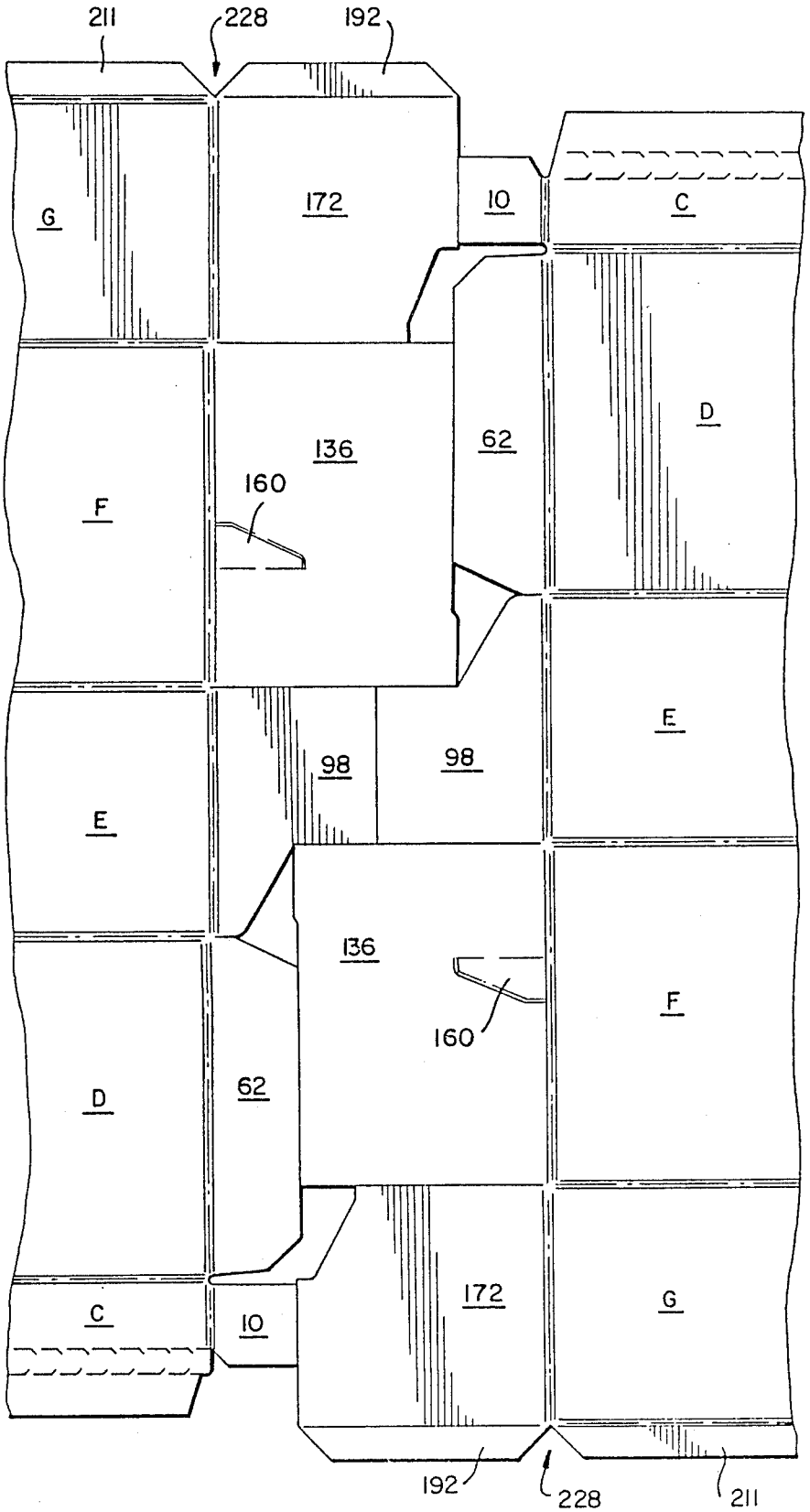
FIG 2 is a fragmentary plan view of a pair of carton blanks illustrating their orientation during the blanking operation.

Referring to FIG. 2, a pair of blanks are illustrated as oriented during the blanking operation. As is evident from the drawing, the end flaps have been designed to reduce the amount of scrap stock produced during the blanking operation and to create an efficient layout by nesting adjacent blanks.

CARTON ASSEMBLY

FIGS. 1, 3A, 3B, AND 4 THROUGH 7

Figure 3A:
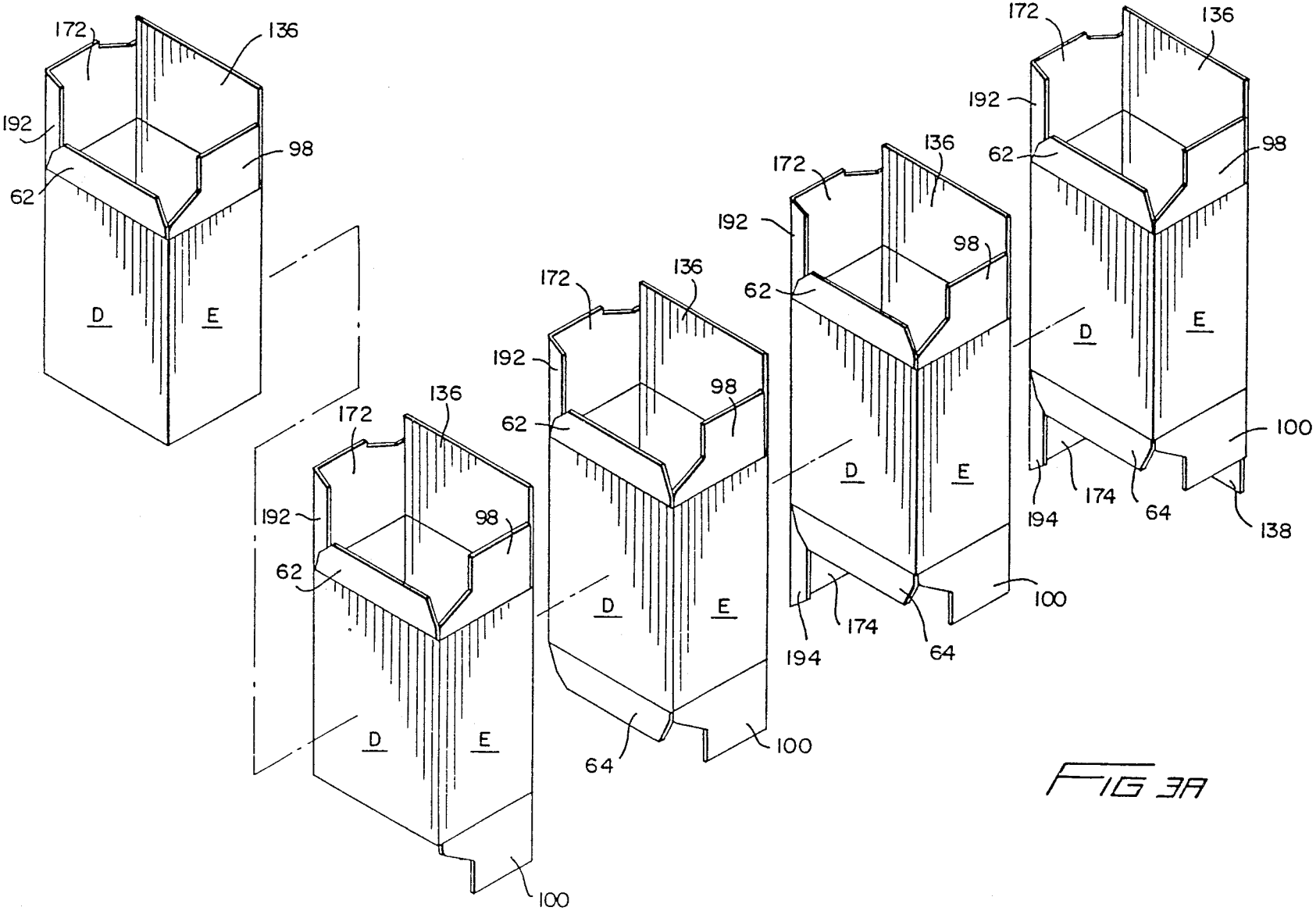
FIG. 3A and B are perspective views of the filling and assembly process of the blank.

The specific steps taken to assemble the blank A will now be described. Initially, the front panel G is folded about hinge line 164 such that it lies on a portion of bottom panel F. Cover panel D and closure flap C are folded about hinge line 90 such that cover panel D overlies rear panel E, a portion of bottom panel F and front panel membrane 211. Closure flap C overlies a portion of front panel G. The front edges 74 of cover end flaps 62 and 64 overlie a portion of end flap membranes 192 and 194 respectively. Pressure is applied to closure flap C to securely fasten it to front panel G. At this stage in the assembly process, the blank A is placed into the hopper of a cartoner; i.e. a mechanical machine for erecting carton blanks. The hopper of the cartoner is designed to hold approximatly 250 blanks oriented in such a manner that the cover, rear bottom and front panels are vertically positioned. The individual blanks are removed from the hopper opened and squared, as best seen in FIG. 3A. In this step, the membrane flaps 192, 194 and 211 are folded to lie in a plane substantially parallel with the cover panel D. Prior designs for cartons employing membrane flaps hingedly connected to the front panel and left and right front panel end flaps have experienced a high stress concentration at hinge lines 54 and 166. As a result, this step of erecting the body panels has been more difficult and has led to tears and severe weakness points about the top front edge of the carton. The present invention has provided a plurality of slits 222 extending completely through hinge line 212 and further has offset hinge line 212 inwardly from top edges 180 of front panel end flaps 172 and 174. This feature permits the body panels to be readily erected without experiencing any undue stress on the carton.

The blank A with the body panels erected and end flaps extending substantially planar to the corresponding body panels, is positioned to move through the cartoner with the cover panel D leading. The cartoner performs all folding steps to the lower or left end flaps, including the application of adhesive, prior to filling. Specifically, bottom panel end flap 138 is folded inwardly so that it is substantially perpendicular with bottom panel F. Subsequently, the front panel end flap 174 is folded inward such that end flap membrane 194 is biased upwardly against cover panel D by cam surface 154 of bottom panel 138. Front panel 174 overlies a portion of bottom panel 138. Cut-out 190 of front panel 174 cooperates with raised or offset portion 160 of bottom panel end flap 138 such that raised portion 160 is substantially planar with front panel end flap 174, as best seen in FIG. 6.

Cover panel end flap 64 is folded inward to overlie front panel end flap 174 and bottom panel end flap 138. Adhesive strip I is applied to bottom panel end flap 138 along raised portion 160 and an adjacent portion of front panel end flap 174. Subsequently, rear panel end flap 100 is folded inwardly to overlie cover panel end flap 64, bottom panel end flap 138 and front panel end flap 174. A force is applied to rear panel end flap 100 adjacent its bottom edge to fasten rear panel end flap 100 to bottom panel end flap 138 and front panel end flap 174. Raised portion 160 provides a substantially planar surface between bottom panel end flap 138 and front panel end flap 174 to securely fasten the rear panel end flap 100 to the bottom panel end flap 138 and front panel end flap 174. The cover or glue tab 12 is folded inwardly to overlie cover panel end flap 64 and a force is applied thereto to secure the same to cover panel end flap 64. The left or lower end of the carton K is thus sealed.

Figure 3B:
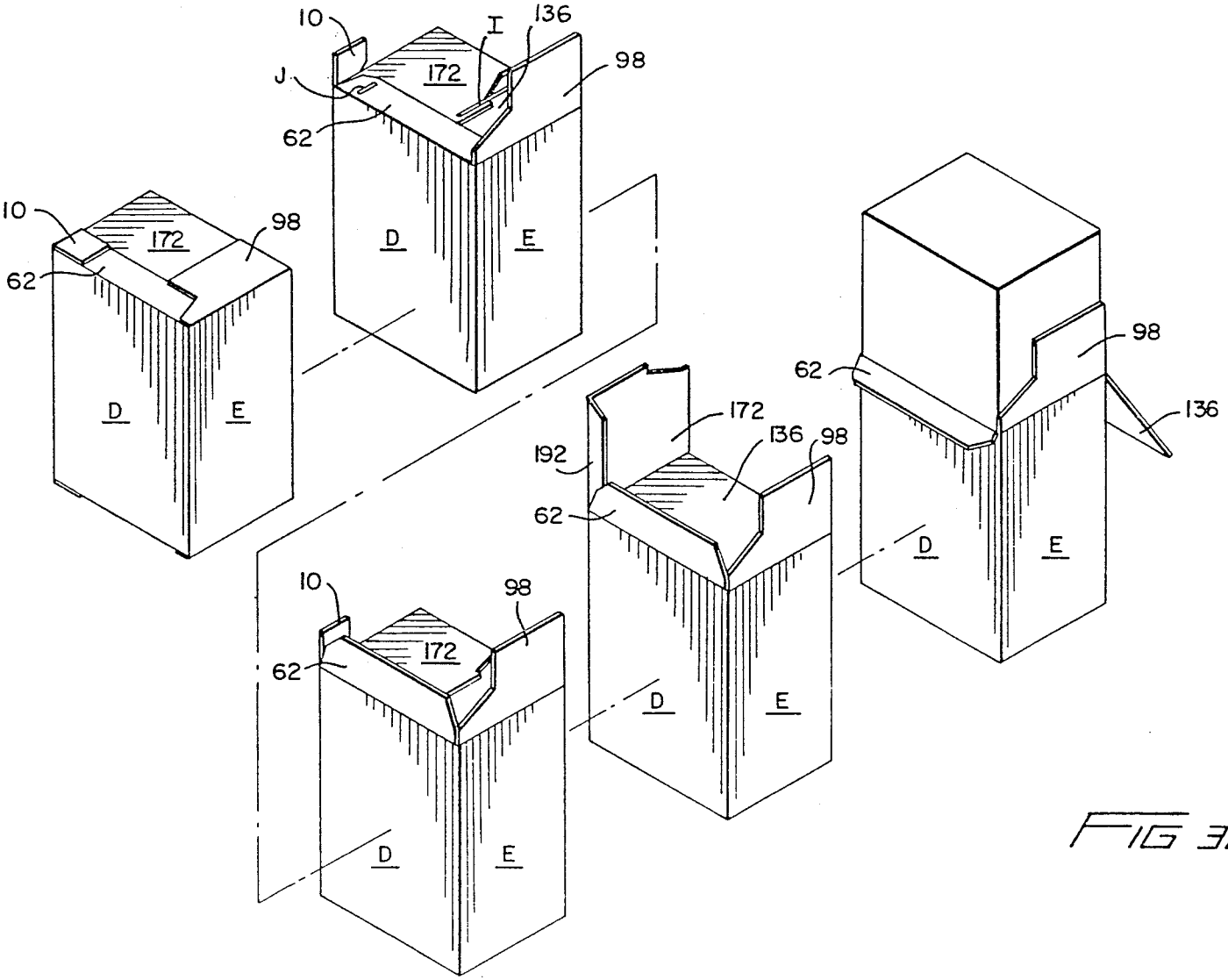

Referring to FIG. 3B, bottom panel end flap 136 and cover panel end flap 62 are folded outwardly to form a throat for receiving the contents of the carton. Subsequently, the carton K is filled with ice cream or similar type semi-liquid contents. Upon filling of the carton K, the force on bottom panel end flap 136 and cover panel end flap 62 is removed resulting in the end flaps moving to an upright position.

Front panel end flap 172 is folded inwardly such that front panel end flap membrane 192 engages cam surface 154 formed on bottom panel end flap 136 and is thereby biased upwardly into abutting contact with cover panel D. This feature of the present invention significantly enhances the seal of the carton end. Cover panel end flap 62 is subsequently folded inwardly to overlie front panel end flap 172 and bottom panel end flap 136 as best seen in FIG. 6. Adhesive strips I and J are applied to the upper carton end in an identical manner as applied to the lower carton end. Subsequently, rear panel end flap 98 is folded inwardly and secured to bottom panel end flap 136 and front panel end flap 172. Finally, cover tab 10 is folded inwardly and secured to cover panel end flap 62 via adhesive strip J. Thus the carton K is sealed as shown in FIG. 7.

Referring to FIG. 4, a prior art ice cream carton formed in accordance with U.S. Pat. No. 4,555,027 is depicted. As is readily seen from the drawing, a swell or rise of the contents of the carton occurs at the upper end upon completion of the filling operation. This will result in residue being formed on the cover panel end flap 62'. The end flaps of the prior art carton are folded inwardly in such a manner that the residue will remain on the cover panel end flap 62'.

Specifically, the rear panel end flap 98' is folded inwardly first followed by the front panel end flap 172'. Subsequently, the cover panel end flap 62' is folded inwardly followed by the bottom panel end flap 136'. As is readily evident from the folding steps of the prior art carton, the residue formed on the cover panel end flap 62' will seap out of the front and rear edges 74' and 76' once cover panel end flap 62' comes into contact with rear panel end flap 98' and front panel end flap 172'. This will result in an unsightly carton and may project an image of a damaged product. Thus, consumers will be very unlikely to purchase such a carton and the carton and its contents will ultimately be disguarded.

CARTON OPENING

FIG. 8

Figure 8:
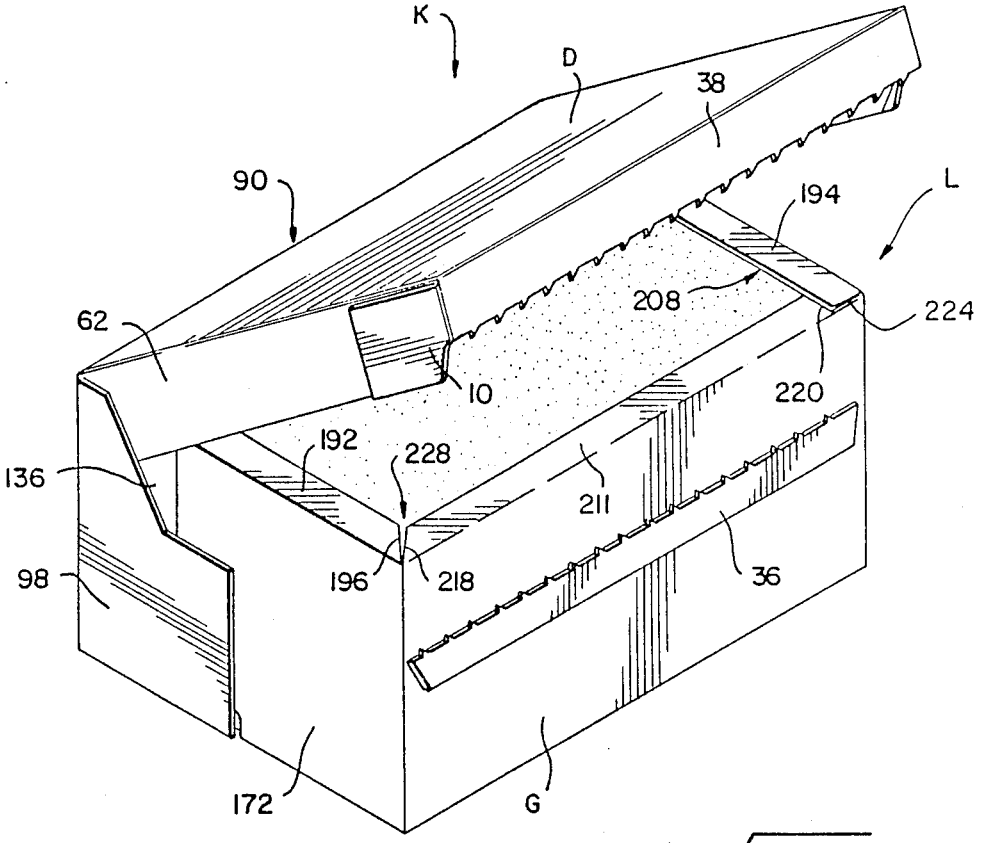
FIG. 8 is a perspective of the carton with the tear strip removed and the cover partially raised.

The steps necessary to obtain access to the contents of the carton K will now be explained with reference to FIG. 8. To detach the cover panel D from the front panel G, one need only pull on tear tab 50 and remove tear strip 30 from front panel F. This enables a consumer to bend the cover panel D backwards about hinge line 90 to gain access to the contents of the carton K.

The membrane flaps 192, 194 and 211 form a continuous lip L about a portion of the outer periphery of carton K. The lip L significantly enhances the seal of carton K. As seen in FIG. 8, the V-shaped notch 228 permits the front edge 196 of end flap membrane 192 to abut left end flap 218 of front panel membrane 211. The complementary 45° angles formed in front panel end flap membrane 192 and front panel membrane 211 provide lip L with a sealed left front corner. The rectangularly shaped notch 224 permits a portion of edge 208 of end flap membrane 194 to abut right edge 220 of front panel membrane 211 thereby forming a substantially sealed right front corner in lip L. The seal formed by the complementary 45° angles is preferable to that formed by the rectangular notch 224.

ALTERNATIVE EMBODIMENT FOR CARTON BLANK

FIGS. 9 THROUGH 21

Figure 10:
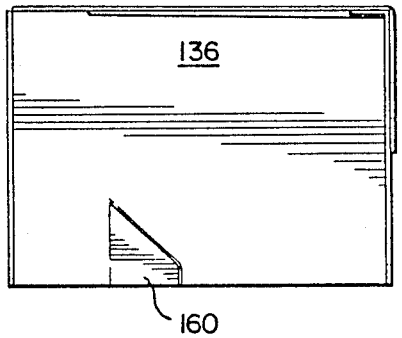
FIG. 10 is a side elevation view of the left end of the second embodiment of the carton with only the bottom panel end flap folded inwardly.
Figure 11:
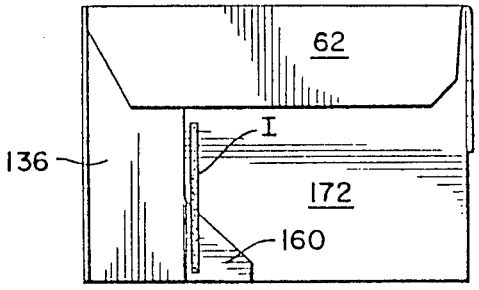
FIG. 11 is a side elevation view of the left end of the second embodiment of the carton depicting the end flaps folded inwardly with the exception of the rear panel end flap.
Figure 9:
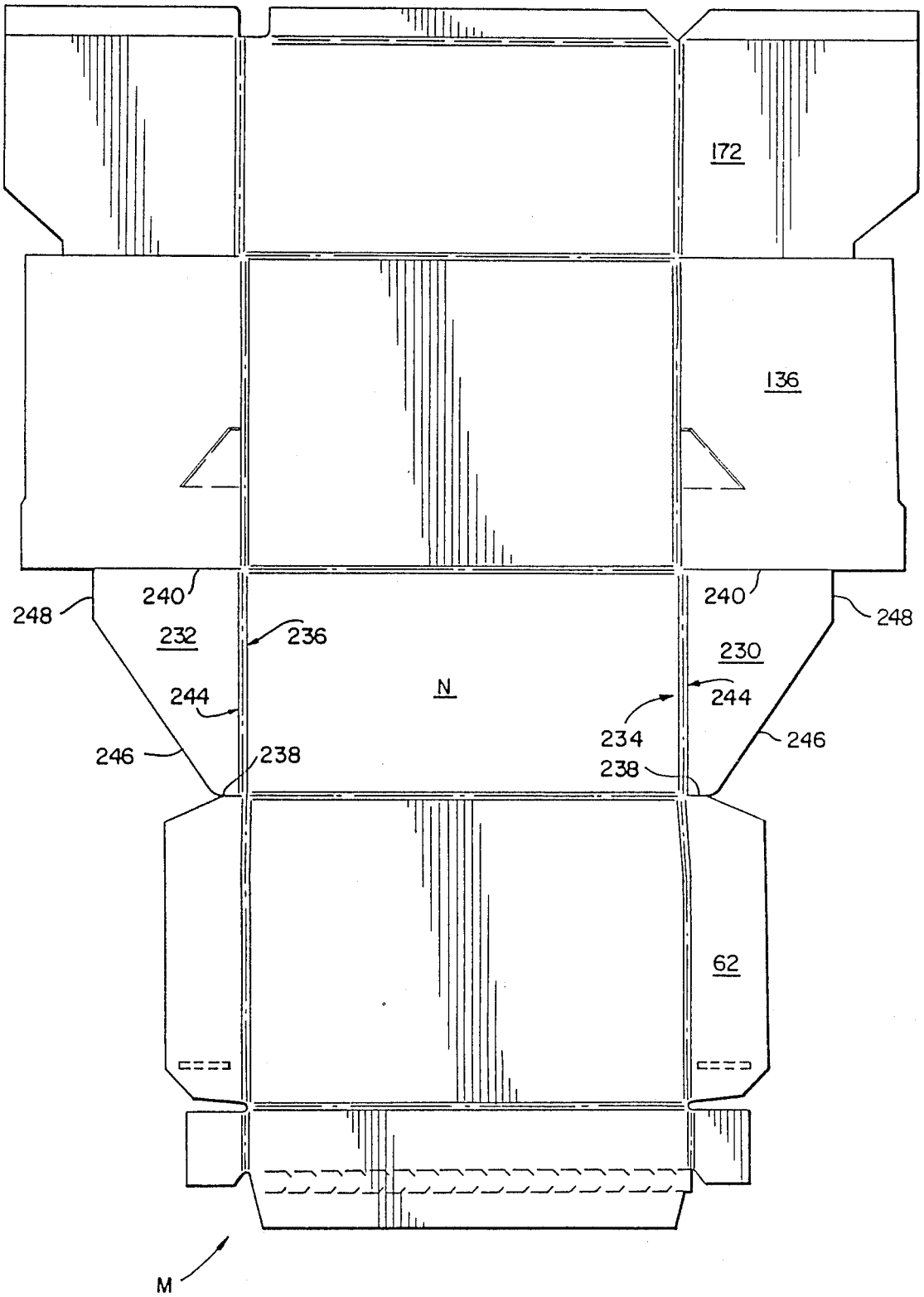
FIG. 9 is a plan view of the inner surface of a second embodiment of a flat carton blank formed in accordance with the present invention.
Figure 16:
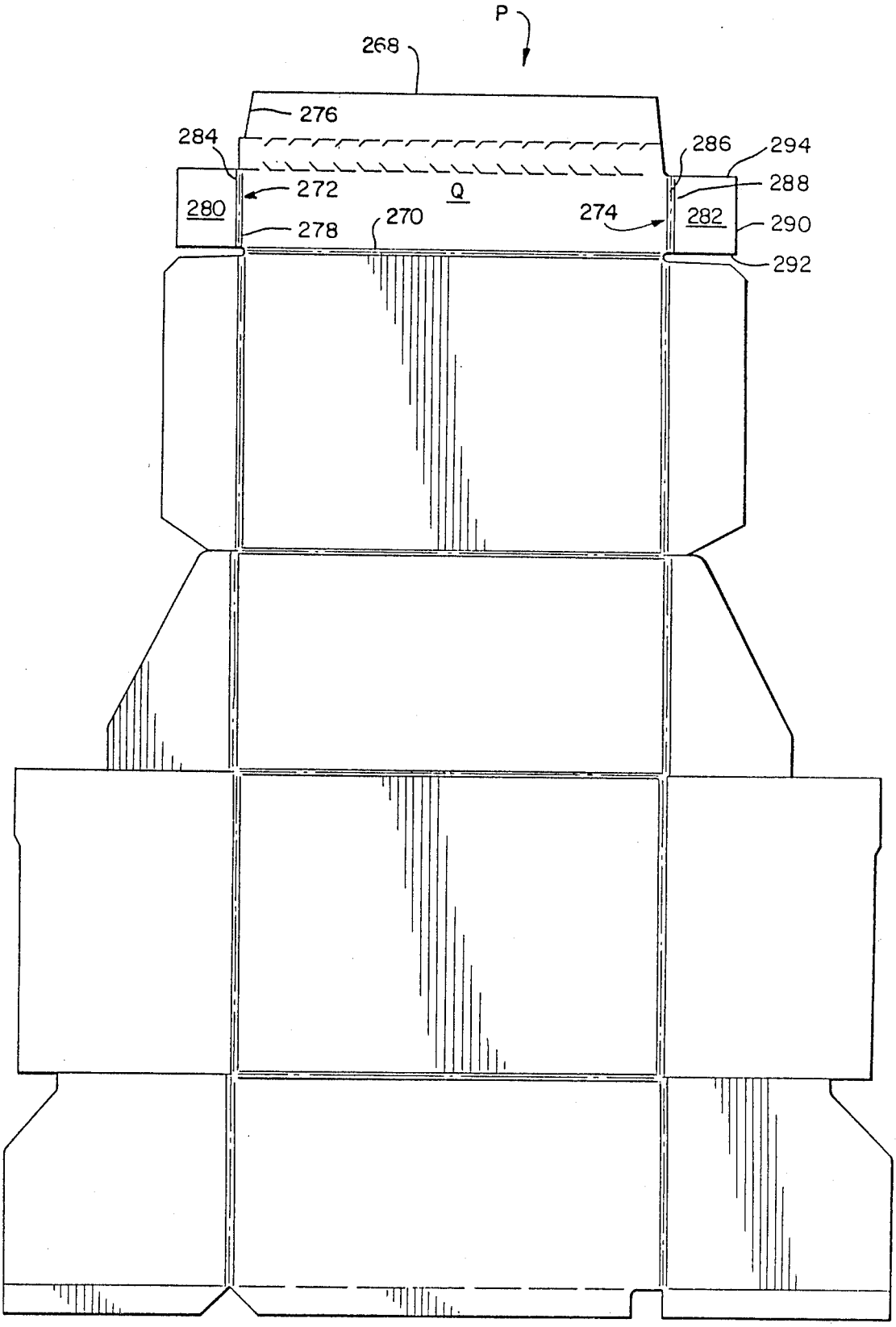
FIG. 16 is a plan view of the inner surface of the fourth embodiment of a flat carton blank formed in accordance with the present invention.

The second embodiment of the carton blank will be described with reference to FIGS. 9 through 12. Blank M, as best seen in FIG. 9, is similar to carton blank A and thus only the differences therebetween will be discussed. Rear panel end flaps 230 and 232 are hingedly connected to rear panel N at left and right edges 234 and 236 respectively. Rear panel end flaps 230 and 232 are defined by top edge 238, bottom edge 240, front edge 242 and rear edge 244. Front edge 242 includes first and second portions 246 and 248. First portion 246 extends from top edge 238 and forms an obtuse angle less than 180° therewith. Second portion 248 extends from first portion 242 and forms an obtuse angle less than 180° therewith. Second portion 248 further extends parallel to rear edge 244. This particular configuration of the rear panel end flaps, unlike the rear panel end flaps 98 and 100 of carton blank A, are compatible with presently known blanking appartii. Therefore, a manufacturer need not incur any additional expense in either modifying the current used blanking devices or in the development of a new blanking device. As is seen in FIGS. 10 through 12, the sequence of folding the end flaps is identical to that of carton blank A.

The third embodiment of the carton blank will be described with reference to FIGS. 13 through 15. Blank O is similar to blanks A and M, therefore, only the differences therebetween will be discussed. Further, since blank O is symmetrical only one side is shown in FIG. 13. Front end flap membrane 246 includes a beveled inner edge 248 for facilitating the assembly of the carton ends. Front panel end flap 250 includes a substantially rectangular shaped notch 252 formed in its rear edge 254. Rear end flap panels 256 include first, second and third offset portions 258, 260 and 262 respectively. Referring to FIG. 14, cut-out 252 is configured identically to third portion 262 and cooperates therewith so that offset third portion 262 is substantially planar with front panel end flap 250. Further, as best seen in FIG. 15, second portion 260 is substantially planar with cover panel end flap 264. This particular configuration of the rear panel end flap 256 insures that it will be securely fastened to bottom panel end flap 266 and front panel and flap 250.

The fourth embodiment of the carton blank formed in accordance with the present invention will be described with reference to FIGS. 16 through 19. Carton blank P is similar to carton blank A and M and, therefore, only the difference therebetween will be hereinafter discussed. Closure flap Q of carton blank P is defined by bottom edge 268, top edge 270, left edge 272, and right edge 274. Left and right edges 272 and 274 each include first and second portions 276 and 278. Cover tabs 280 and 282 are hingedly connected to second portions 278 of left and right edges 272 and 274 respectively forming hinge lines 284 and 286 therebetween. Cover or glue tabs 280 and 282 are defined by front edge 288, rear edge 290, top edge 292, and bottom edge 294. Front edges 288 extend the length of corresponding hinge lines 284 and 286. This particular arrangement eliminates the notch or recess formed intermediate bottom edges 294 of the cover tabs 280 and 282 and closure flap Q. By eliminating these notches, the cover tabs 280 and 282 are significantly strengthened.

Figure 17:
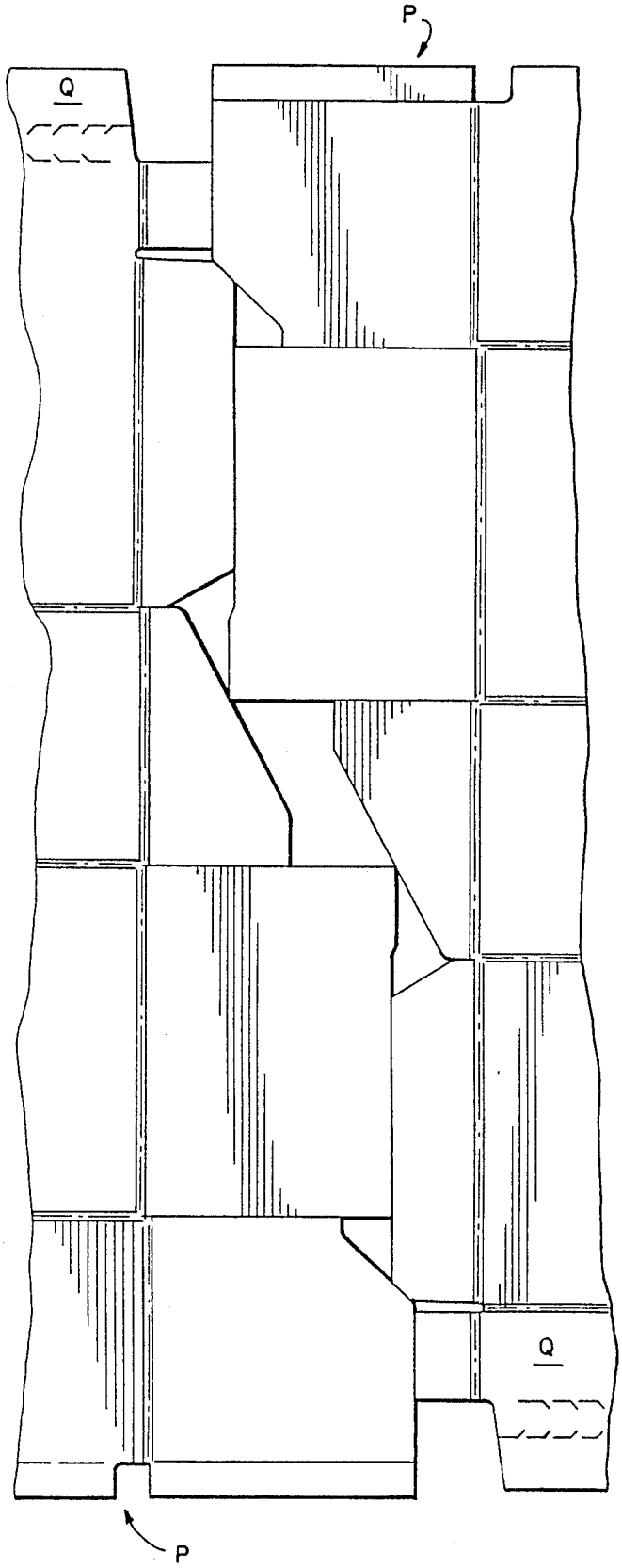
FIG. 17 is a fragmentary plan view of a pair of carton blanks, formed in accordance with the fourth embodiment of the present invention, illustrating their orientation during the blanking operation.
Figure 18:
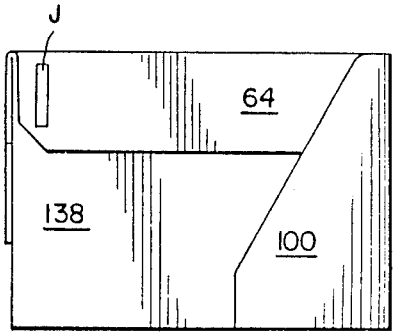
FIG. 18 is a side elevation view of the right end of the fourth embodiment of the carton depicting the end flaps folded inwardly with the exception of the (cover tab).
Figure 19:
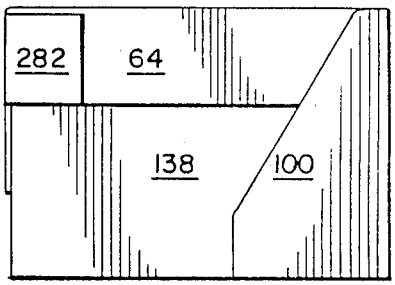
FIG. 19 is a side elevation view of a sealed end of the fourth embodiment of the carton depicting the right carton end sealed.

Referring to FIG. 17, a pair of carton blanks formed in accordance with the fourth embodiment of present invention are illustrated as oriented during the blanking operation. As is evident from the drawing, the end flaps have been designed to reduce the amount of scrap stock produced in the blanking operation, and to produce an efficient nesting layout.

Figure 20:
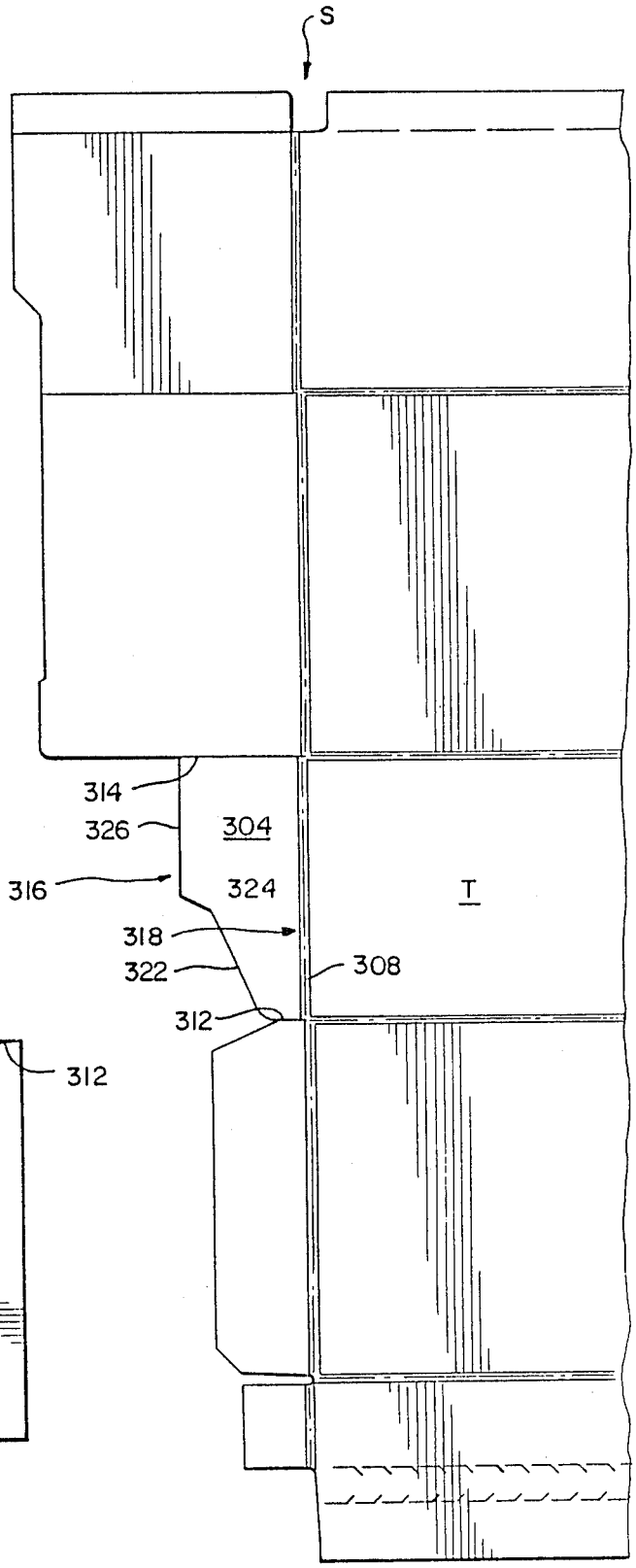
FIG. 20 is a partial fragmentary plan view of the inner surface of the fifth embodiment of a flat carton blank formed in accordance with the present invention.
Figure 21:
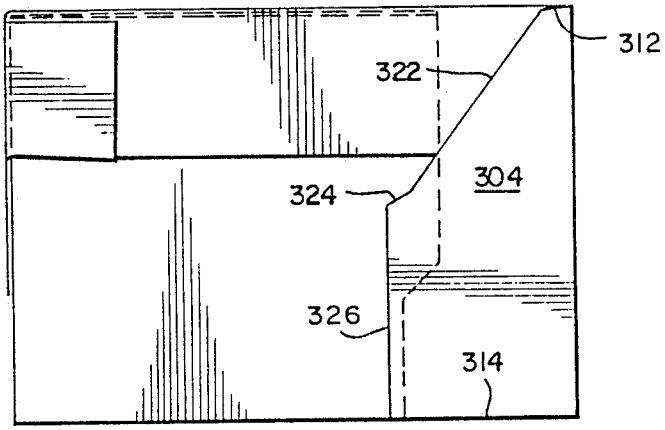
FIG. 21 is a side elevation view of a sealed end of the fifth embodiment of a carton blank.

The fifth and final embodiment of the carton blank formed in accordance with the present invention will be described with reference to FIGS. 20 and 21. Since carton blank S is symmetrical only a portion thereof will be shown. Carton blank S includes rear panel end flap 304 hingedly connected to rear panel T forming hinge line 308 therebetween. Rear panel end flap 304 is defined by top edge 312, bottom edge 314, front edge 316 and rear edge 318. Front edge 316 includes first, second, and third portions 322, 324 and 326 respectively. First portion 322 extends from top edge 312 and forms an obtuse angle of less than 180° therewith. Second portion 324 extends angularly from first portion 322 and forms an obtuse angle greater than 180° therewith. Third portion 326 extends from second portion 324 and forms an obtuse angle less than 180° therewith. Further, third portion 318 extends substantially parallel to the corresponding hinge line 308. The advantage of this particular design for rear panel end flap 304 is seen in FIG. 21 i.e. the formation of a substantially continuous end surface. Thus, the carton ends formed in accordance with the fifth embodiment of present invention readily accommodate printed matter and various illustrations associated with ice cream cartons informing the consumer of the type of ice cream contained therein as well as the brand name.

While this invention has been described as having a preferred design, it is understood that it is capable of further modification, uses and/or adaptations of the invention following in general the principle of the invention and including such departures from the present disclosure as come within known or customary practice in the art to which the invention pertains, such as may be applied to essential features set forth, and fall within the scope of the invention of the limits of the appended claims.

What claim is:

1. A carton for packaging ice cream or the like, comprising:

(a) connected cover, front, bottom, and rear panels;
(b) said cover and bottom panels each having front, rear, left and right edges;
(c) said front and rear panels each having top, bottom, left and right edges;
(d) said cover panel having a closure flap hingedly connected to said cover panel at said cover panel front edge;
(e) said rear panel being hingedly connected at its top edge to said rear edge of said cover panel;
(f) said bottom panel being hingedly connected at its rear edge to said bottom edge of said rear panel;
(g) said front panel being hingedly connected at its bottom edge to said front edge of said bottom panel;
(h) said panels each having left and right end flaps connected to said left and right edges respectively forming hinge lines therebetween;
(i) said left end flaps being dimensioned such that upon folding of said left and flaps inward, to form the left end of the carton, is substantially sealed for preventing leadage therefrom;
(j) said right end flaps being dimensioned such that the right end of the carton is substantially sealed for preventing leakage therefrom;
(k) said front panel having a membrane flap extending from the top edge of said front panel;
(l) said left and right front panel end flaps each having a membrane flap extending from said top edges;
(m) said left and right front panel end flap membranes and said front panel membrane forming a substantially continuous lip extending inwardly and along at least a portion of an outer periphery of the carton;
(n) a cam means being formed in each of said bottom panel end flaps and said cam means being operably associated with the corresponding front panel end flaps for biasing said front panel end flap membranes toward said cover panel upon folding of the corresponding front panel end flaps inwardly to form th carton ends;
(o) said bottom panel end flaps each including a top edge; and
(p) said cam means including said top edge sloping downwardly along a portion of said top edge.

2. A carton as in claim 1, wherein:

(a) first and second portions formed in said top edge of said bottom panel end flaps;
(b) said second portion of said top edge is adjacent said rear panel;
(c) said first portion includes first and second ends;
(d) said first end is adjacent said front panel and said second end is adjacent said second portion;
(e) the distance between said second portion and said bottom panel is greater than the distance between said second end and said bottom panel; and
(f) the distance between said first end and said bottom panel is greater than the distance between said second end and said bottom panel.

3. A carton as in claim 1, wherein:

(a) said hinge lines formed intermediate said front panel and said left front panel end flap, said rear panel and said left rear panel end flaps, and said left cover panel and said cover panel end flap each includes at least a first segment;
(b) said hinge line formed intermediate said bottom panel and said left bottom panel end flap includes at least a first segment;
(c) said first segments of said hinge lines formed intermediate said front, rear and cover panels and the corresponding left panel end flaps are substantially aligned; and
(d) said first segment of said hinge line formed intermediate said bottom panel and said left bottom panel end flap is offset from said first segments of said hinge lines formed intermediate said front, rear and cover panels and the corresponding left panel end flaps.

4. A carton as in claim 3, wherein:

(a) said hinge lines formed intermediate said front panel and said right front panel end flap, said rear panel and said right rear panel end flap, and said cover panel and said right cover panel end flap each includes at least a first segment;
(b) said hinge line formed intermediate said bottom panel and said right bottom panel end flap includes at least a first segment;
(c) said first segments of said hinge lines formed intermediate said front, rear and cover panels and the corresponding right panel end flaps are substantially aligned; and (d) said first segment of said hinge lines formed intermediate said bottom panel and said right bottom panel end flap is offset from said first segments of said hinge lines formed intermediate said front, rear and cover panels and the corresponding right panel end flaps.

5. A carton as in claim 4, wherein:

(a) said hinge lines formed intermediate said cover panel and said left and right cover panel end flaps each include a second segment; and (b) said second segments are tapered inwardly adjacent said rear panel.

6. A carton as in claim 1, wherein:

(a) said left and right bottom panel end flaps being folded in first thereby forming the interior wall of the carton;

(b) said left and right front panel end flaps being folded in second such that said front panel end flaps overlap only a portion of the corresponding bottom panel end flap, said left and right cover panel end flaps, being folded in third to form at least a portion of the exterior walls of the carton, said cover panel end flaps overlapping only a portion of the corresponding front and bottom panel end flaps, thereby defining an exposed area in said bottom panel end flap not overlapped by said front and cover panel end flaps;

(c) said left and right bottom panel end flap each having an embossed portion, at least a portion of said embossed portion being disposed within said exposed area; and (d) said left and right rear panel end flaps being folded in fourth to form at least a portion of the exterior wall of the carton, said rear panel end flaps overlapping a portion of the corresponding bottom, front and cover panel end flaps, said rear panel end flaps each having a lower portion overlapping said at least portion of said embossed portion, whereby said rear panel end flaps may be secured to the corresponding said at least portion of said embossed portion.

7. A carton, as in claim 1 and further comprising:

(a) pocket means for receiving a portion of said cover panel end flap adjacent said rear panel for reforming said carton subsequent to initial removal of said closure flap from said front panel; and (b) said pocket means including rear panel end flaps forming an exterior portion of said pocket means operably associated with at least one other end flap of said receptacle forming an interior portion of said pocket means.

8. A carton, as in claim 1, wherein:

(a) said closure flap includes at least one weakness line formed therein for permitting detachment of said cover panel from said front panel.

9. A carton, as in claim 1, wherein:

(a) said closure flap includes top, bottom, left and right edges;

(b) said left and right edges each having a cover tab extending therefrom; and (c) means for securing said cover tabs to the corresponding cover panel end flaps.

10. A blank for forming a carton for packaging ice cream and the like, comprising:

(a) connected cover, front, bottom, and rear panels;

(b) said cover and bottom panels each having front, rear, left and right edges;

(c) said front and rear panels each having top, bottom left and right edges;

(d) said cover panel having a closure flap hingedly connected to said cover panel at said cover panels front edge;

(e) said rear panel being hingedly connected at its top edge to said rear edge of said cover panel;

(f) said bottom panel being hingedly connected at its rear edge to said bottom edge of said rear panel;

(g) said front panel being hingedgly connected at its bottom edge to said front edge of said bottom panel;

(h) said panels each having left and right end flaps connected to said left and right edges respectively forming hinge lines therebetween;

(i) said left end flaps being dimensioned such that upon folding of said left end flaps inward, to form the left end of the carton the left end is substantially sealed for preventing leakage therefrom;

(j) said right end flaps being dimensioned such that upon folding of said right end flaps inward, to form the right end of the carton, the right end is substantially sealed for preventing leakage therefrom;

(k) said front panel having a membrane flap extending from the top edge of said front panel;

(l) said left and right front panel end flaps each having a membrane flap extending from said top edges;

(m) said left and right front panel end flap membranes and said front panel membrane forming a substantially continuous lip extending inwardly and along at least a portion of an outer periphery of the carton;

(n) a cam means being formed in each of said bottom panel end flaps and said cam means being operably associated with the corresponding front panel end flaps for biasing said front panel end flap membranes toward said cover panel upon folding of the corresponding front panel end flaps inwardly to form the carton ends when the carton is erected.

(o) said bottom panel end flaps each including a top edge; and (p) said cam means including said top edge sloping downwardly along a portion of said top edge.

11. A blank as in claim 10, wherein:

(a) first and second portions formed in said top edge of said bottom panel end flaps;

(b) said second portion of said top edge is adjacent said rear panels when said bottom panel end flap is in the erected position;

(c) said first portion includes first and second ends;

(d) said first end is adjacent said front panel when said bottom panel end flap is in the erected position and said second end is adjacent said second portion;

(e) the distance between said second portion and said bottom panel is greater than the distance between said second end and said bottom panel; and (f) the distance between said first end and said bottom panel is greater than the distance between said second end and said bottom panel.

12. A blank as in claim 10, wherein:

(a) said hinge lines formed intermediate said front panel and said left front panel end flap, said rear panel and said left rear panel end flaps, and said left cover panel and said cover panel end flap each includes at least a first segment;

(b) said hinge line formed intermediate said bottom panel and said left bottom panel end flap includes at least a first segment;

(c) said first segments of said hinge lines formed intermediate said front, rear and cover panels and the corresponding left panel end flaps are substantially aligned; and (d) said first segment of said hinge line formed intermediate said bottom panel and said left bottom panel end flap is offset from said first segments of said hinge lines formed intermediate said front, rear and cover panels and the corresponding left panel end flaps.

13. A blank as in claim 12, wherein:

(a) said hinge lines formed intermediate said front panel and said right front panel end flap, said rear panel and said right rear panel end flap, and said cover panel and said right cover panel end flap each includes at least a first segment;

(b) said hinge line formed intermediate said bottom panel and said right bottom panel end flap includes at least a first segment;

(c) said first segments of said hinge lines formed intermediate said front, rear and cover panels and the corresponding right panel end flaps are substantially aligned; and (d) said first segment of said hinge lines formed intermediate said bottom panel and said right bottom panel end flap is offset from said first segments of said hinge lines formed intermediate said front, rear and cover panels and the corresponding right panel end flaps.

14. A blank as in claim 13, wherein:

(a) said hinge lines formed intermediate said cover panel and said left and right cover panel end flaps each include a second segment; and (b) said second segments are tapered inwardly adjacent said rear panel.

15. A blank, as in claim 10, wherein:

(a) said left and right bottom panel end flaps when folded, being folded in first for thereby forming the interior wall of the carton, said left and right front panel end flaps when folded, being folded in second such that said front panel end flaps overlap only a portion of the corresponding bottom panel end flaps, said left and right cover panel end flaps when folded, being folded in third such that said cover panel end flaps overlap only a portion of the corresponding bottom and front panel end flaps, whereby an exposed area in each of said bottom panel end flaps is nonoverlapping with respect to said front and cover panel end flaps;

(b) said bottom panel end flaps each include an embossed portion, at least a portion of said embossed portion is disposed within said exposed area; and (c) said left and right rear panel end flaps when folded, being folded in fourth for forming at least a portion of the exterior wall of the carton, said rear panel end flaps overlapping a portion of the corresponding bottom, front and cover panel end flaps, said rear panel end flaps having a lower portion overlapping said at least portion of said embossed portion, whereby said rear panel end flaps may be secured to the corresponding said at least portion of said embossed portion.

16. A blank as in claim 10 and further comprising:

(a) pocket means when said blank is formed into a carton for receiving a portion of said cover panel end flaps adjacent said rear panel for reforming said carton subsequent to initial removal of said closure flap from said front panel; and (b) said pocket means includes said rear panel end flaps forming an exterior portion of said pocket means operably associated with at least one other end flap of said carton forming an interior portion of said pocket means.

17. A blank as in claim 10 wherein:

(a) said closure flap having at least one weakness line formed therein for permitting detachment of said cover panel from said front panel when said blank is fully erected into a carton.

18. A blank as in claim 10, wherein:

(a) said closure flap includes top, bottom, left and right edges;

(b) said left and right edges each having a cover tab extending therefrom; and (c) means for securing said cover tabs to the corresponding cover panel end flaps.

* * * * *